US005492275A

United States Patent [19]

Crampton

[11] Patent Number: 5,492,275

[45] Date of Patent: Feb. 20, 1996

[54] HAND PUMP SPRAYER WITH ROTATING NOZZLE AND SYSTEM FOR DISPENSING VISCOUS LIQUIDS

[75] Inventor: David C. Crampton, Westminster, Calif.

[73] Assignee: Par-Way Group, Irvine, Calif.

[21] Appl. No.: 243,366

[22] Filed: May 16, 1994

[51] Int. Cl.[6] ..... B05B 9/043

[52] U.S. Cl. ..... 239/333; 239/537; 239/544; 239/573

[58] Field of Search ..... 239/329, 331, 239/333, 337, 340, 246, 526, 537, 543, 544, 573; 222/383

[56] References Cited

U.S. PATENT DOCUMENTS

| | | | |
|---|---|---|---|
| 3,701,478 | 10/1972 | Tada | 239/333 |
| 3,896,975 | 7/1975 | Follmer | 222/192 |
| 3,927,834 | 12/1975 | Tada | 239/359 |
| 4,646,969 | 3/1987 | Sorm | 239/106 |
| 4,838,490 | 6/1989 | Nissels | 239/333 |
| 5,088,649 | 2/1992 | Hanson | 239/329 |
| 5,156,304 | 10/1992 | Battegazzore | 239/333 X |

FOREIGN PATENT DOCUMENTS

| | | | |
|---|---|---|---|
| 8701618 | 3/1987 | WIPO | 239/333 |

*Primary Examiner*—Andres Kashnikow
*Assistant Examiner*—Lesley D. Morris
*Attorney, Agent, or Firm*—James A. Quinton

[57] ABSTRACT

The hand pump sprayer and system for dispensing viscous liquids are provided. A nozzle is rotatably mounted around the delivery passageway of a hand pump sprayer. The nozzle is interconnected to the trigger of the hand pump sprayer so that the nozzle rotates, upon pulling of the trigger, simultaneously with the discharge of the liquid to the atmosphere. The nozzle rotates about an axis of rotation through the center of the discharge end of the nozzle through an angle of rotation from about 90° to about 360°, desirably from 180° to 360° and preferably 270° or more. Desirably the nozzle has two discharge outlets which direct fluid expelled from the hand pump sprayer along intersecting discharge axes. Simultaneously as the fluid is discharged along the intersecting axes, the nozzle is rotated about the axis of rotation. The resulting dispensed liquid has a high degree of atomization and a desirable round spray pattern.

31 Claims, 13 Drawing Sheets

HAND PUMP SPRAYER WITH ROTATING NOZZLE AND SYSTEM FOR DISPENSING VISCOUS LIQUIDS

BACKGROUND OF THE INVENTION

1. Field of the Invention

The present invention relates to improvements in hand pump sprayers and particularly in hand pump sprayers of the trigger type.

2. Description of the Prior Art

Aerosol containers have been in widespread use for dispensing of a variety of products. These dispensers have been of particular value in dispensing viscous liquids. Commonly, a hydrocarbon propellant has been used with viscous products particularly viscous hydrocarbon based products. Under pressure in an aerosol container, hydrocarbon propellant serves as a diluent and thus reduces the viscosity and surface tension of the viscous liquid. See for example U.S. Pat. No. 3,896,975. Efforts are now under way to eliminate hydrocarbon propellants from the environment. Freon has already been banned, out of concern for the ozone layer. Other hydrocarbons such as isobutane and propane and other volatile organic compounds (VOCS) have been identified as contributing factors in air pollution in urban areas. Thus, such propellants are undesirable and need to be removed from the spray containers.

Hand pump sprayers of the trigger type are known in the art. See U.S. Pat. Nos. 3,701,478, 3,927,834 and 4,646,969 and U.S. Pat. No. 5,088,649.

Pump sprayable dispensing systems for viscous liquids have been developed in the prior art. For example, U.S. Pat. No. 5,088,649 describes a hand pump sprayer which can dispense a fine spray of viscous liquid without the need of using hydrocarbon propellants or other diluents. The fluid delivered by the hand pump sprayer of the '649 patent exits from the nozzle in two streams which collide at a point exterior to the nozzle assembly. The resulting spray pattern of such a sprayer is fan shaped. However, there are some applications where a fan shaped pattern is inconvenient.

Sprayers which have nozzles which can be rotated about their delivery passageway to allow the user to select different predetermined shaped nozzle holes are known. See U.S. Pat. No. 4,838,490. Pump sprayers which allow the movement of the nozzle outlet between two extreme positions during dispensing of the fluid are known in the art. See U.S. Pat. No. 5,152,425.

SUMMARY OF THE INVENTION

The present invention is directed to an improved hand pump sprayer. The invention also relates to a system for dispensing viscous liquids. The hand pump sprayer according to the invention provides improved atomization and a circular spray pattern. According to the invention, a nozzle is rotatably mounted around the delivery passageway of a hand pump sprayer. The nozzle is interconnected to the trigger of the hand pump sprayer so that the nozzle rotates upon pulling the trigger simultaneously with the discharge of the liquid to the atmosphere. The nozzle rotates about an axis of rotation through the center of the discharge end of the nozzle through an angle of rotation from about 90° to about 360°, desirably from 180° to 360° and preferably 270° or more. Desirably the nozzle has two discharge outlets which direct fluid expelled from the hand pump sprayer along intersecting discharge axes. Simultaneously as the fluid is discharged along the intersecting axes, the nozzle is rotated about the axis of rotation. The resulting dispensed liquid has a high degree of atomization and a desirable round spray pattern.

It is an object of the invention to provide a hand pump sprayer which gives improved atomization of the delivered liquid.

It is an object of the invention to provide a hand pump sprayer which can dispense viscous products having a viscosity of 60 cps or greater in fine droplets.

It is an object of the invention to provide a hand pump sprayer with improved atomization when spraying viscous and non-viscous liquids.

It is an object of the invention to provide a hand pump sprayer which dispenses viscous products in a round spray pattern.

It is an object of the invention to provide a viscous fluid dispensing system which can readily spray viscous products having a viscosity over 60 cps in fine droplets in a round spray pattern.

It is an object of the invention to provide a hand pump sprayer with a nozzle that rotates about 180° to 360° about an axis X of rotation through the center of the nozzle outlet end as the liquid is expelled to the atmosphere.

According to the invention a hand pump sprayer which provides improved atomization and a round spray pattern is provided. The hand pump sprayer is versatile and can be used with a variety of different viscosity fluids. The sprayer is particularly useful in pumping viscous liquids with a viscosity over 60 cps.

In the prior art, it was difficult if not impossible to pump viscous liquids with a hand pump sprayer and obtain sufficient atomization to deliver the fluid in fine droplets. This problem was substantially remedied by U.S. Pat. No. 5,088,649 which is incorporated by reference herein. In the '649 patent a hand pump sprayer of the trigger type is provided. The '649 sprayer has a first and second discharge axis. The liquid expelled from the '649 sprayer intersects at a collision point exterior to the nozzle assembly and collides to enhance the breakup of the fluid to small droplets. The resulting spray pattern is generally fan shaped.

Many users of spray dispensable products desire the aerosol type spray pattern with its centered outlet which delivers a round spray pattern. Many consumers use round skillets or other such cooking surfaces and desire a round spray pattern. In addition, it is desired that the hand pump sprayer be usable with viscous liquids. Typical aerosol containers and hand pump sprayers have centered discharge outlets in their nozzles. Both aerosol and hand pump sprayers generally deliver a spray in a round pattern. However, in the typical hand pump sprayer, viscous fluids are not sufficiently atomized.

According to the invention a hand pump sprayer of the trigger type wherein fluid is pressurized and brought from a reservoir to the outlet of a delivery passageway upon the pulling of the trigger is provided. A nozzle having an inlet and an outlet is rotatably mounted to the outlet of the delivery passageway. The nozzle rotates about a rotation axis through the center of discharge end of the nozzle. Preferably the nozzle is one that provides colliding streams of fluid intersecting at a point outside the nozzle such as described in the U.S. Pat. No. 5,088,649 (Hanson). Alternatively a nozzle having a single hole which is eccentric that is, off center from the axis of rotation of the nozzle is provided. The trigger of the hand pump sprayer is interconnected to the rotatably mounted nozzle to provide rotation of the nozzle simultaneously with the dispensing of the liquid from the reservoir to the atmosphere. The nozzle rotates from about 90° to 360° about the axis of rotation, most preferably from 180° to 360°. The resulting hand pump sprayer is capable of dispensing viscous liquids having a viscosity over 60 cps and delivering a desirable round spray pattern. In addition, the spray pump of the invention provides increased atomization and misting over that of a conventional sprayer regardless of the viscosity of the liquid pumped.

According to the invention, the hand pump sprayer desirably has a drive gear interconnected and operatively driven by the trigger of the hand pump sprayer. The drive gear is interconnected to a nozzle drive gear which is operatively interconnected to the nozzle. The nozzle drive gear rotates the nozzle about an axis of rotation through the center of the delivery end of the nozzle. The nozzle rotates about the axis of rotation from 90° to about 360° and preferably from 180° to 360° and most preferably 270° or greater simultaneously with the dispensing of the pressurized fluid to the atmosphere by the action of pulling the trigger.

The preferred embodiment of the present invention is illustrated in the drawings and examples. However, it should be expressly understood that the present invention should not be limited solely to the illustrative embodiment.

DETAILED DESCRIPTION OF THE INVENTION

Figure 1:
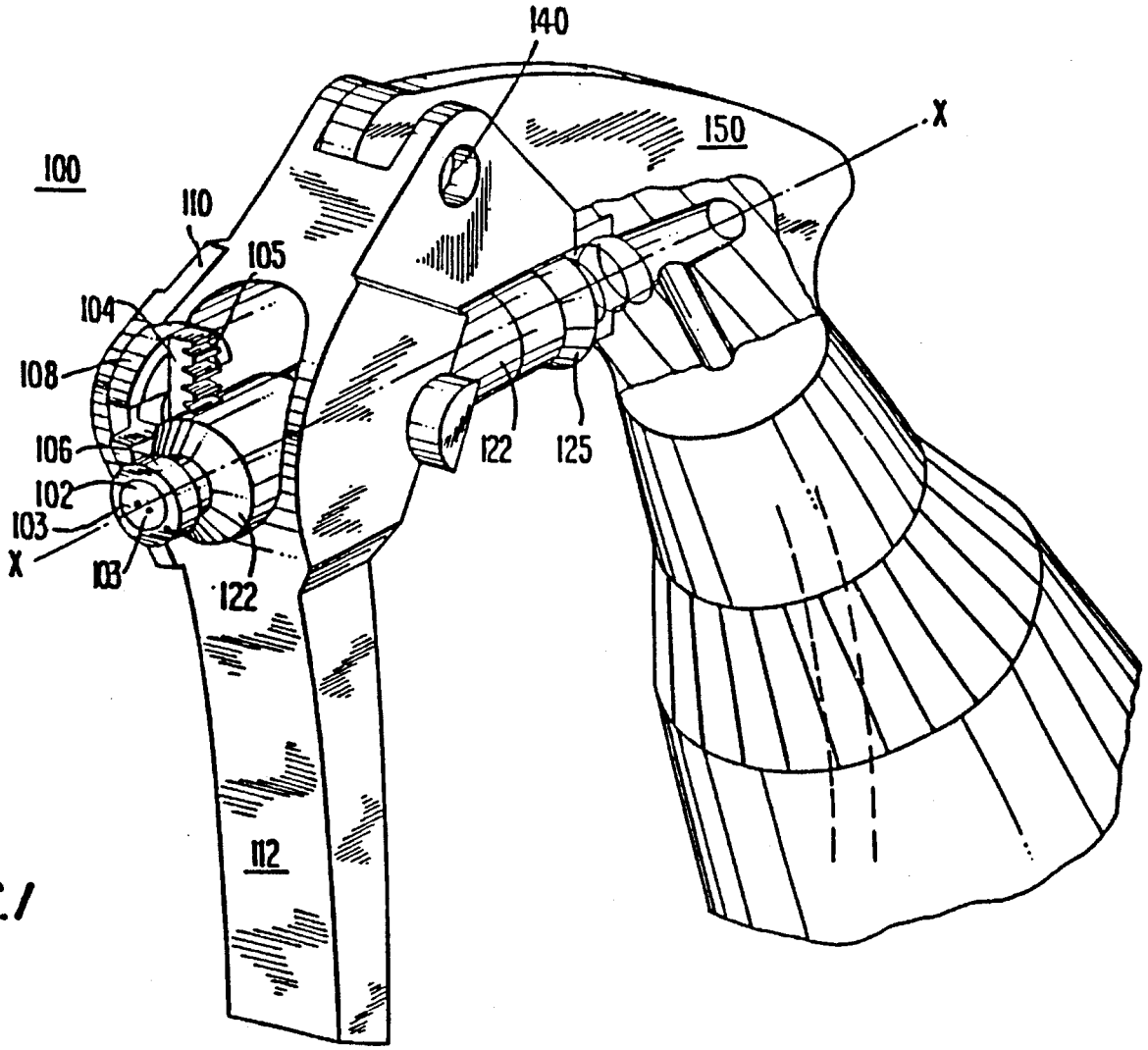
FIG. 1 is a perspective view of the hand pump sprayer according to the invention.
Figure 1A:
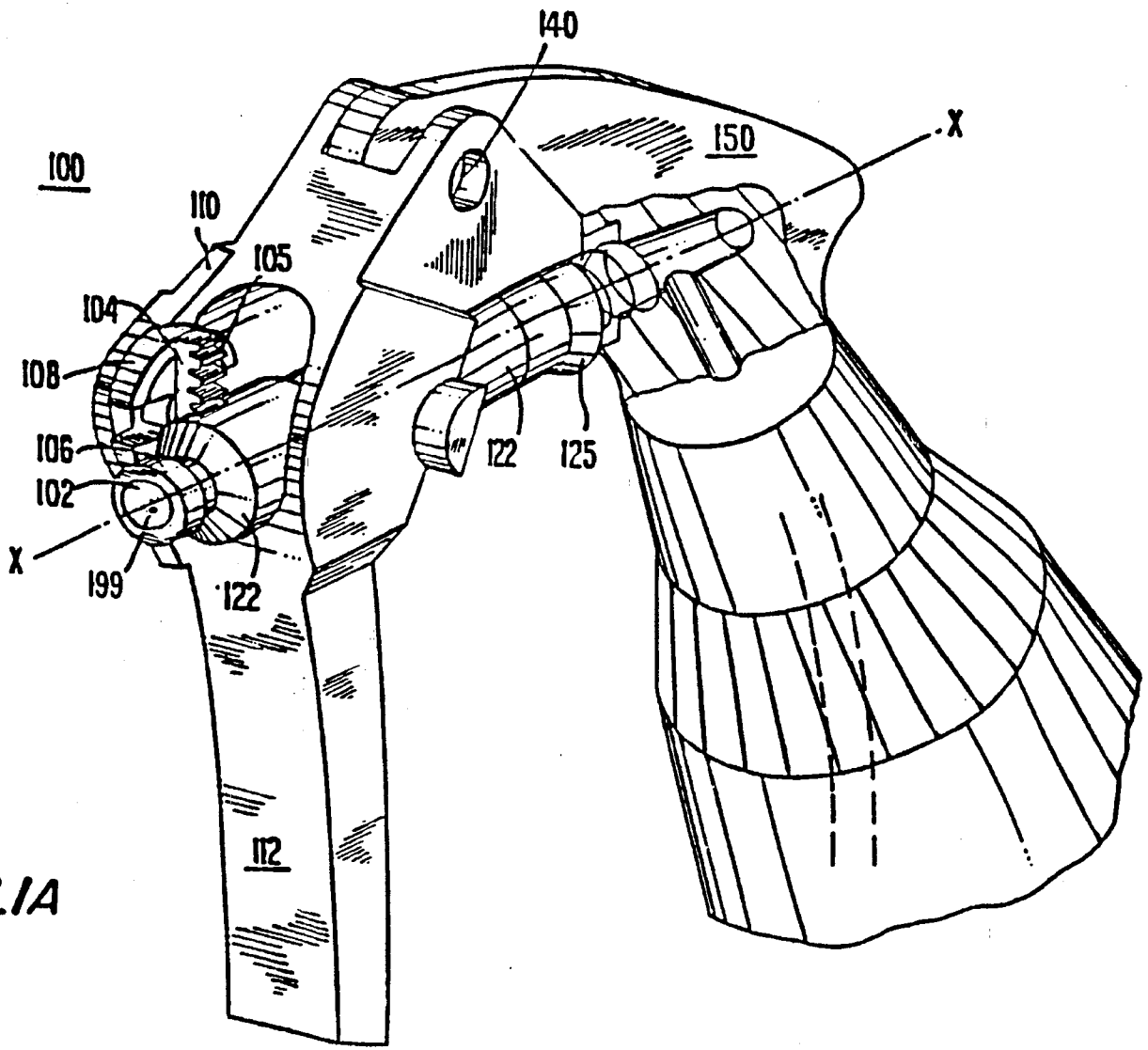
FIG. 1A is a perspective view of an alternative embodiment of the hand pump sprayer according to the invention.
Figure 2:
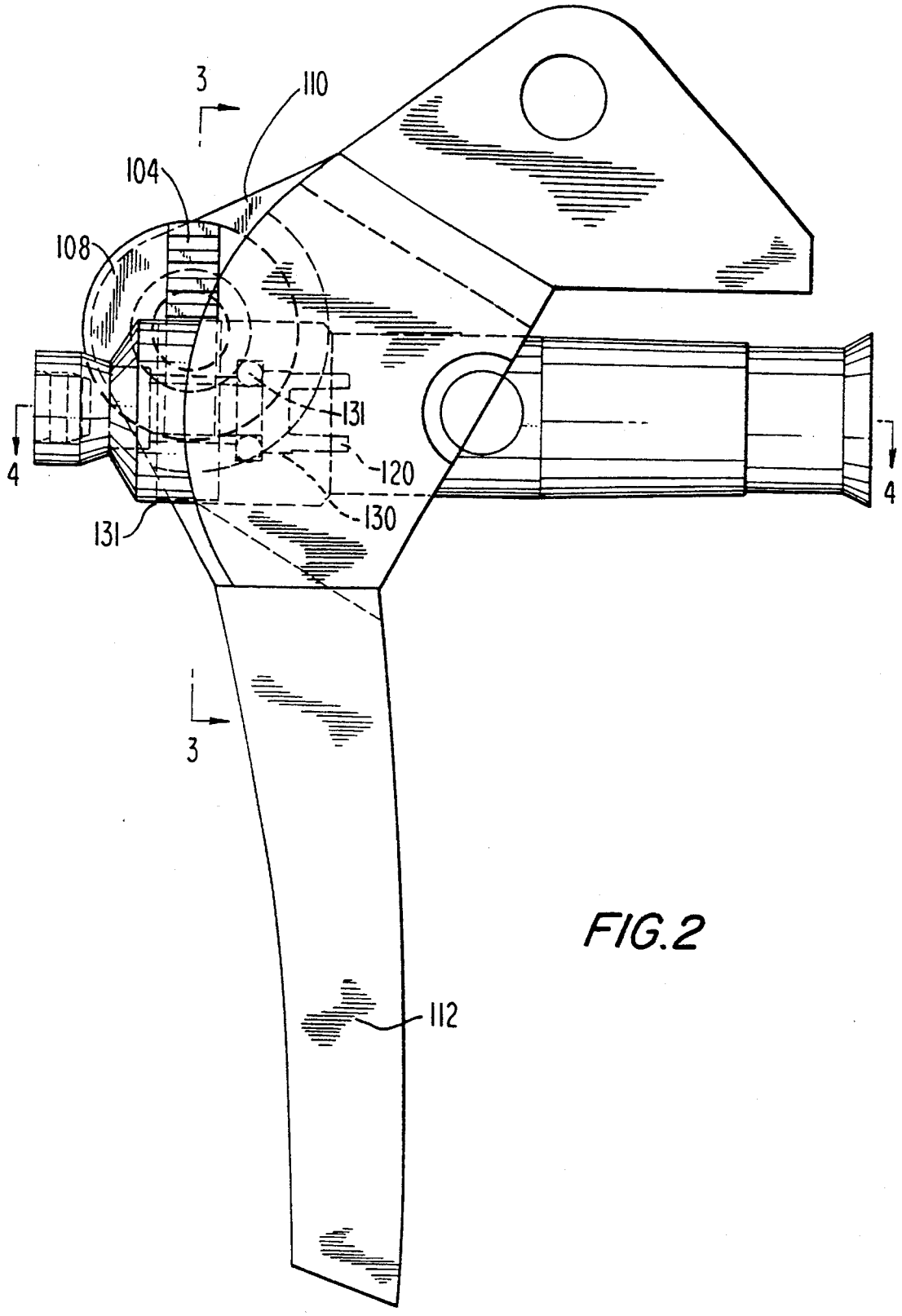
FIG. 2 is a side view of FIG. 1.
Figure 3:
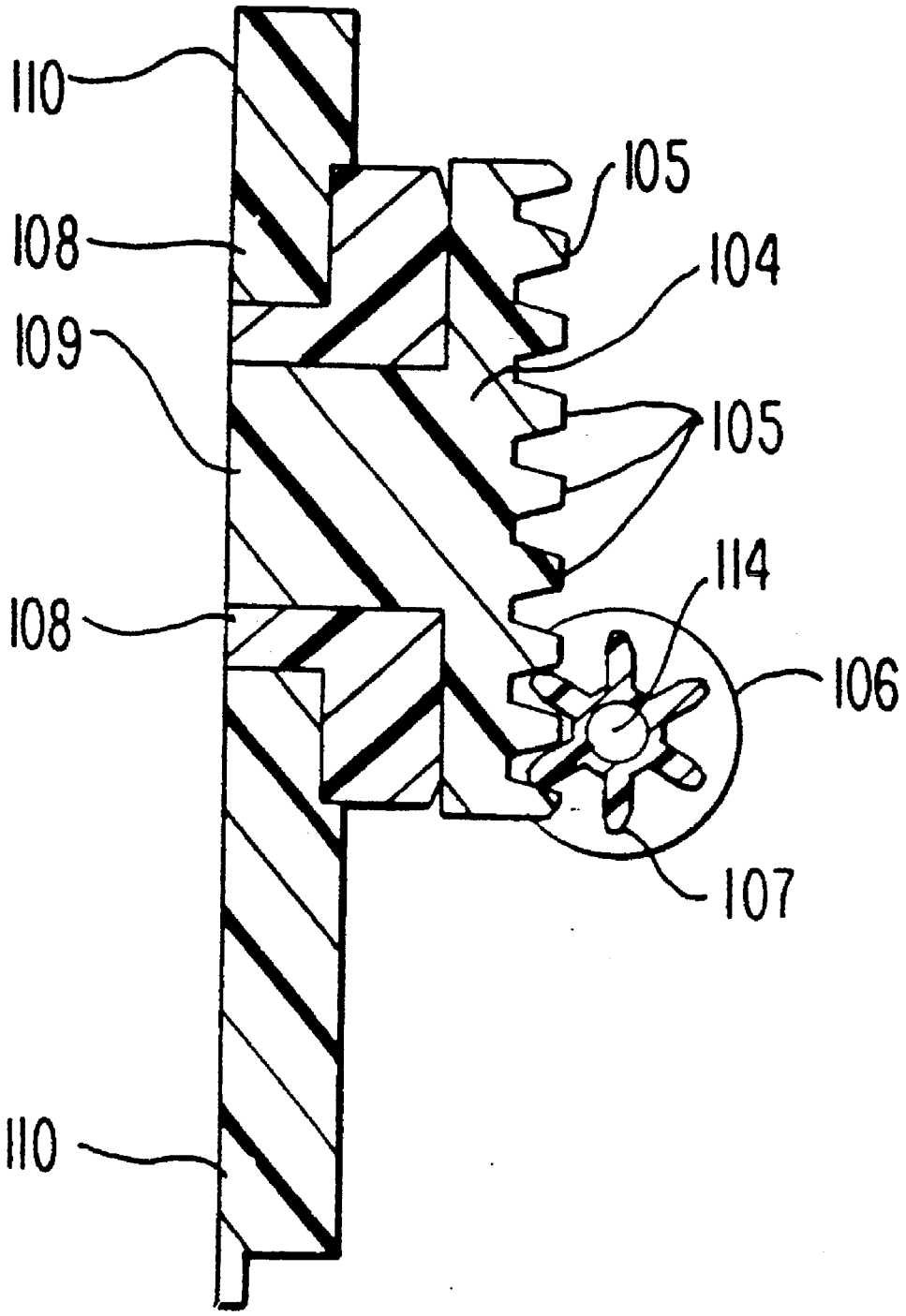
FIG. 3 is a partial sectional view through 3—3 of FIG. 2 to show the arrangement of the rack and pinion with the pinion retainer removed.

The present invention relates to a hand pump sprayer for dispensing of a variety of different liquids. The invention also relates to a system for dispensing viscous fluids. According to the invention a hand pump sprayer has a nozzle which rotates about an axis of rotation through the center of the discharge end of the nozzle through an angle of rotation from 90° to 360° preferably from 180° to 360° and most preferably 270° or more. The nozzle is interconnected to the trigger of a hand pump sprayer so that the nozzle is rotated by pulling the trigger and simultaneously rotates as pressurized fluid is delivered from a reservoir of the hand pump sprayer upon the action of pulling the trigger. The nozzle can have a variety of different discharge outlets. Preferably the nozzle has two discharge outlets which are spaced apart and provide colliding streams of fluid intersecting at a point outside the nozzle such as described in U.S. Pat. No. 5,088,649. Preferably the outlets are on opposite sides of the axis X of rotation. Optionally three or more colliding streams emanating from three or more outlets can be provided. Alternatively a single discharge outlet can be provided. In such instance the discharge outlet is eccentric to the axis of rotation of the rotating nozzle. The resulting hand pump sprayer provides superior atomization of the sprayed liquid and at the same time provides the desirable round spray pattern.

The hand pump sprayer according to the invention is particularly useful with viscous liquids having a viscosity of 60 cps or greater. Most preferably the invention is useful for pump spraying viscous liquids having a viscosity from 60 cps to 100 cps and preferably from 60 to 85 cps and most preferably from 70 to 85 cps. A wide range of viscous products can be dispensed in a fine mist. For example, vegetable oil, vegetable oil lecithin mixtures, paint without volatile organic compounds (VOCS) diluents, e.g., paint pigments in linseed oil, viscous petroleum products, viscous lubricants, adhesives, resins, e.g., hair spray having a viscosity of 60 cps or greater, contemplated according to the invention. Preferably the hand pump sprayer according to the invention is used to pump viscous vegetable oil containing compositions, most preferably vegetable oil lecithin mixtures. Optionally, non-viscous liquids may be used in the pump sprayer according to the invention such as water or alcohol based window cleaners, household cleaners or other water based products. Such liquids are sprayed in a fine mist with superior atomization and a round spray pattern.

According to the invention, a hand pump sprayer is provided which has a nozzle which rotates about an axis X through the center of the outlet end of the nozzle through an angle of rotation from 90° to 360° preferably from 180° to 270° and most preferably over 270° simultaneously with dispensing of product from the spray pump reservoir to the atmosphere. According to the invention, a generally conventional plunger arrangement is used to draw the liquid from the reservoir of the hand pump sprayer to the delivery passageway of the hand pump sprayer. See, for example U.S. Pat. No. 4,646,969 or U.S. Pat. No. 3,927,834 which are incorporated by reference. Desirably a Continental Model 922 modified to have a rotating nozzle is useful in the invention. The liquid is drawn from the reservoir and delivered under pressure to the nozzle through a delivery passageway upon the pulling of a trigger. The nozzle is operatively driven by the action of the trigger of the hand pump sprayer. Preferably the nozzle is rotated by a nozzle drive gear which imparts rotational movement to the nozzle as the trigger is moved back and forth. There are a variety of gearing arrangements possible to translate the back and forth trigger movement to rotational movement of the nozzle. The nozzle drive gear can be directly driven by a rack attached to the trigger as shown in FIGS. 1 to 10. In such instance the nozzle drive gear will in fact be a pinion interacting directly with a gear rack attached to the trigger. Alternatively as shown in FIGS. 11 to 14, the nozzle drive gear can be driven indirectly by the trigger through several gears which are ultimately operated by the back and forth movement of the trigger.

Figure 4:
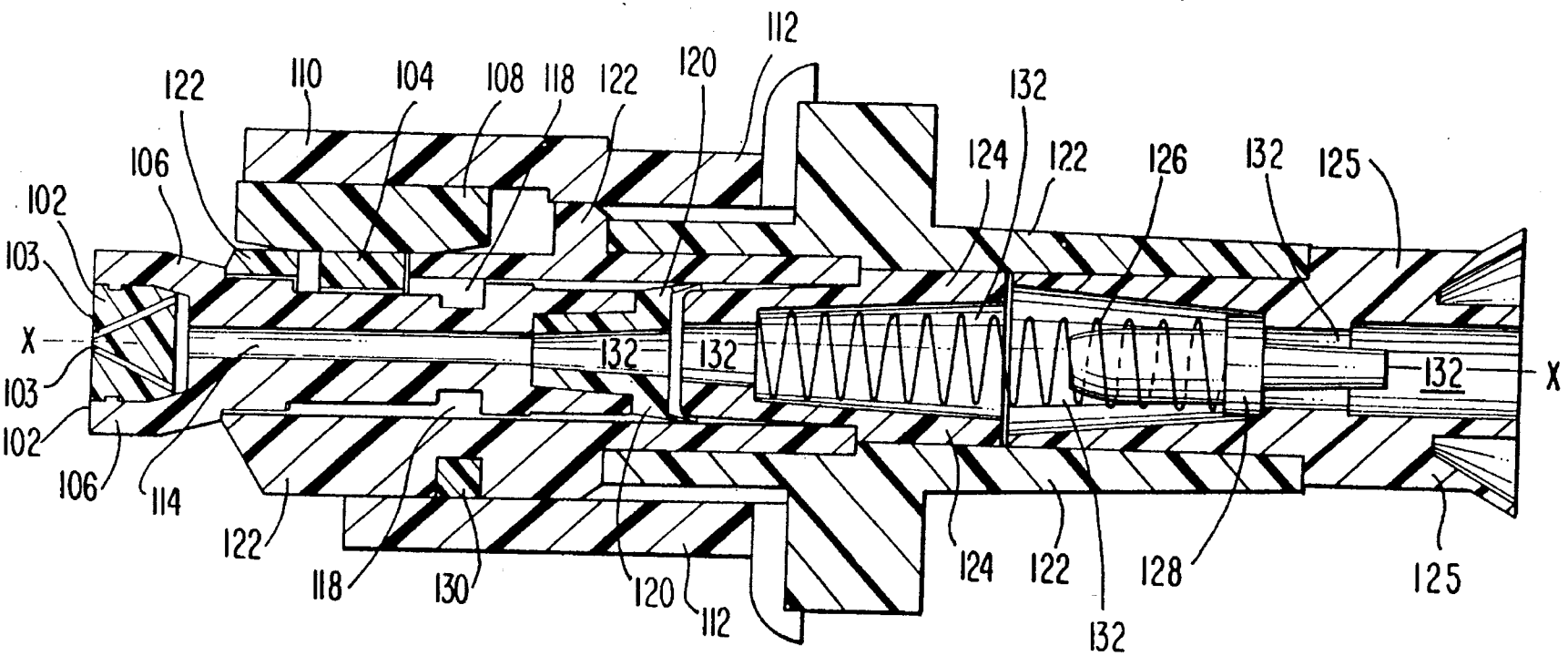
FIG. 4 is a sectional view through 4—4 of FIG. 2.
Figure 5A:
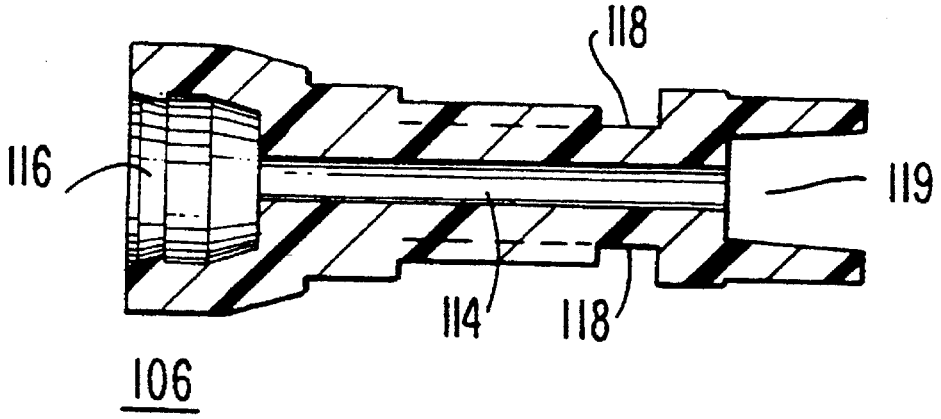
FIG. 5A is a sectional top view of the pinion assembly through 5A—5A of FIG. 5.
Figure 5:
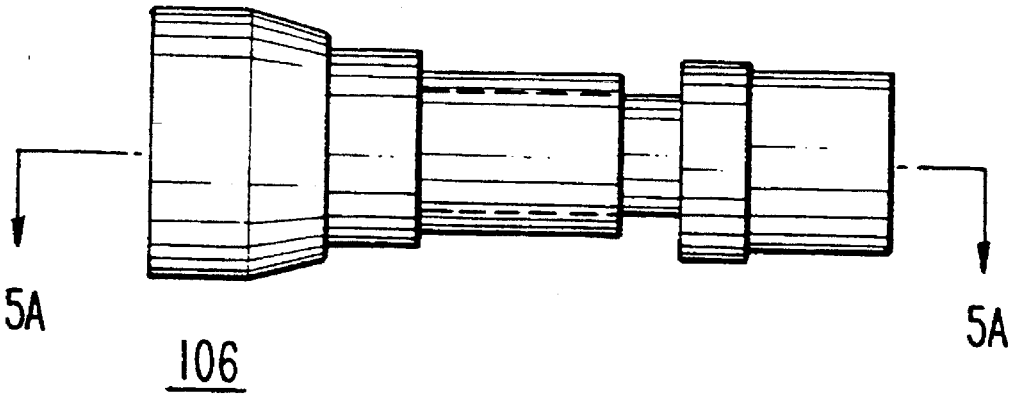
FIG. 5 is a side view of the pinion assembly used in the hand pump sprayer of FIG. 1.
Figure 6:
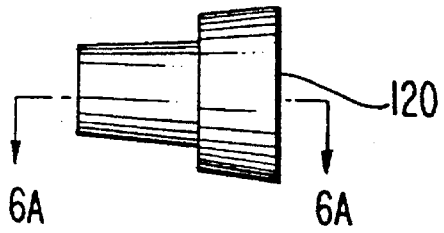
FIG. 6 is the pinion seal used in the hand pump sprayer of FIG. 1.
Figure 6A:
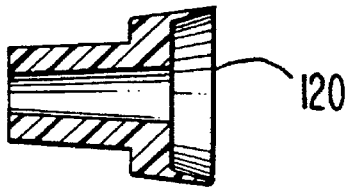
FIG. 6A is a section through 6A—6A view of the pinion seal of FIG. 6.
Figure 7:
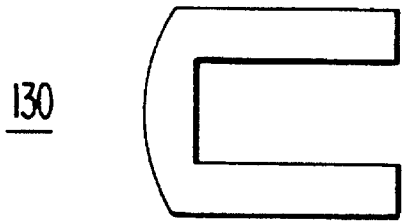
FIG. 7 is a side view of the U-shaped retainer used in the hand pump sprayer of FIG. 1.
Figure 8A:
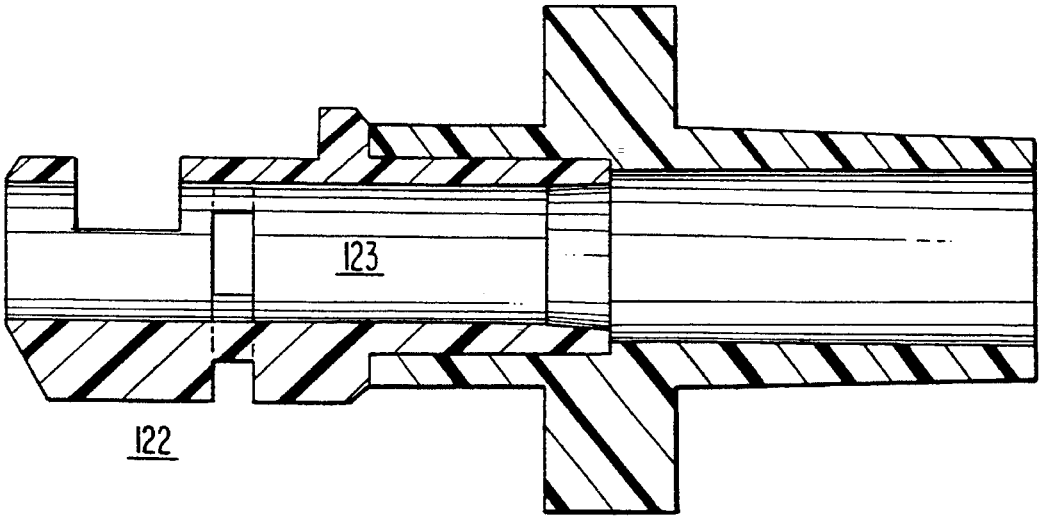
FIG. 8A is a sectional view of FIG. 8 through 8A—8A.
Figure 8:
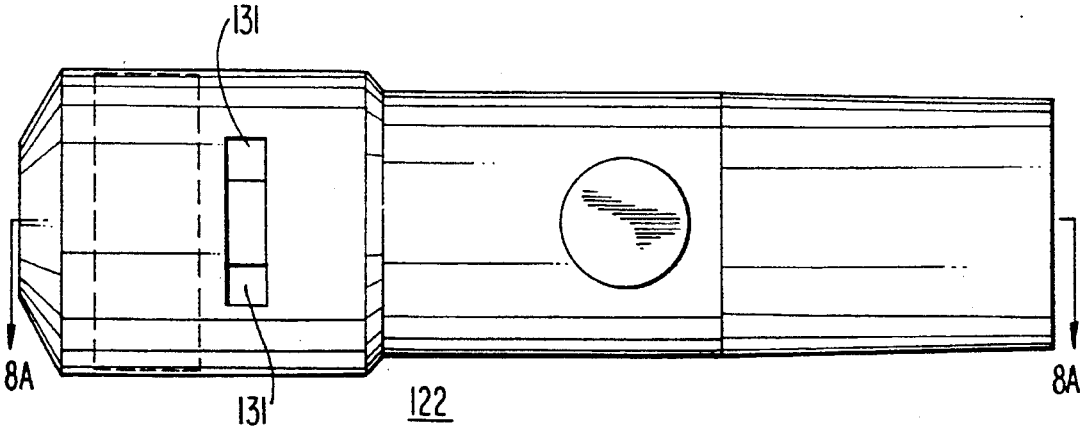
FIG. 8 is a side view of the plunger used in the hand pump sprayer of FIG. 1.
Figure 9:
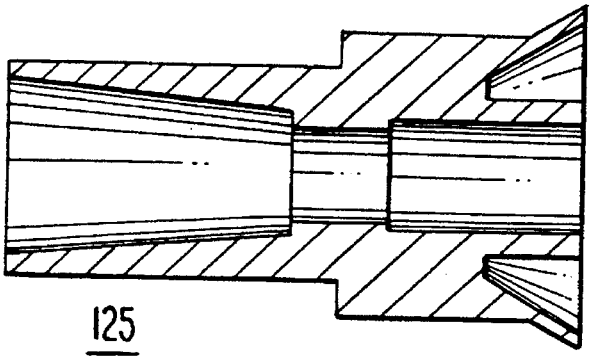
FIG. 9 is a sectional view of the plunger seal used in the hand pump sprayer of FIG. 1.
Figure 10:
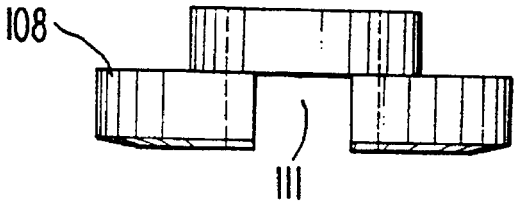
FIG. 10 is a side view of the rack positioner of the hand pump sprayer of FIG. 1.
Figure 10A:
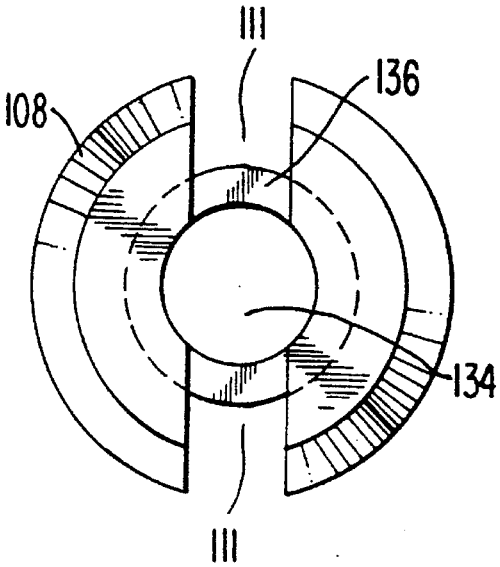
FIG. 10A is a front view of the rack positioner.
Figure 11:
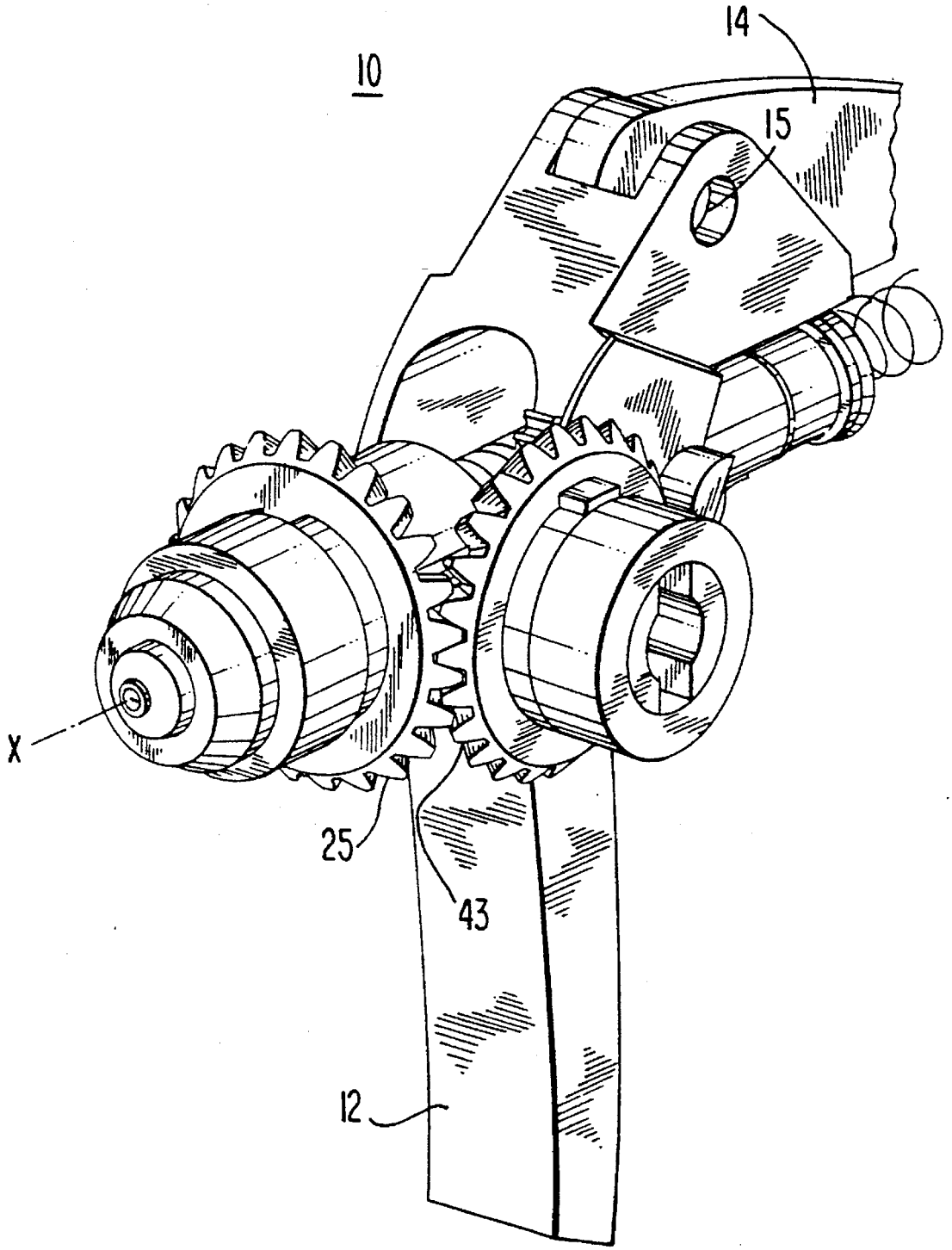
FIG. 11 is perspective view of an alternative embodiment of the hand pump sprayer according tol the invention.
Figure 12:
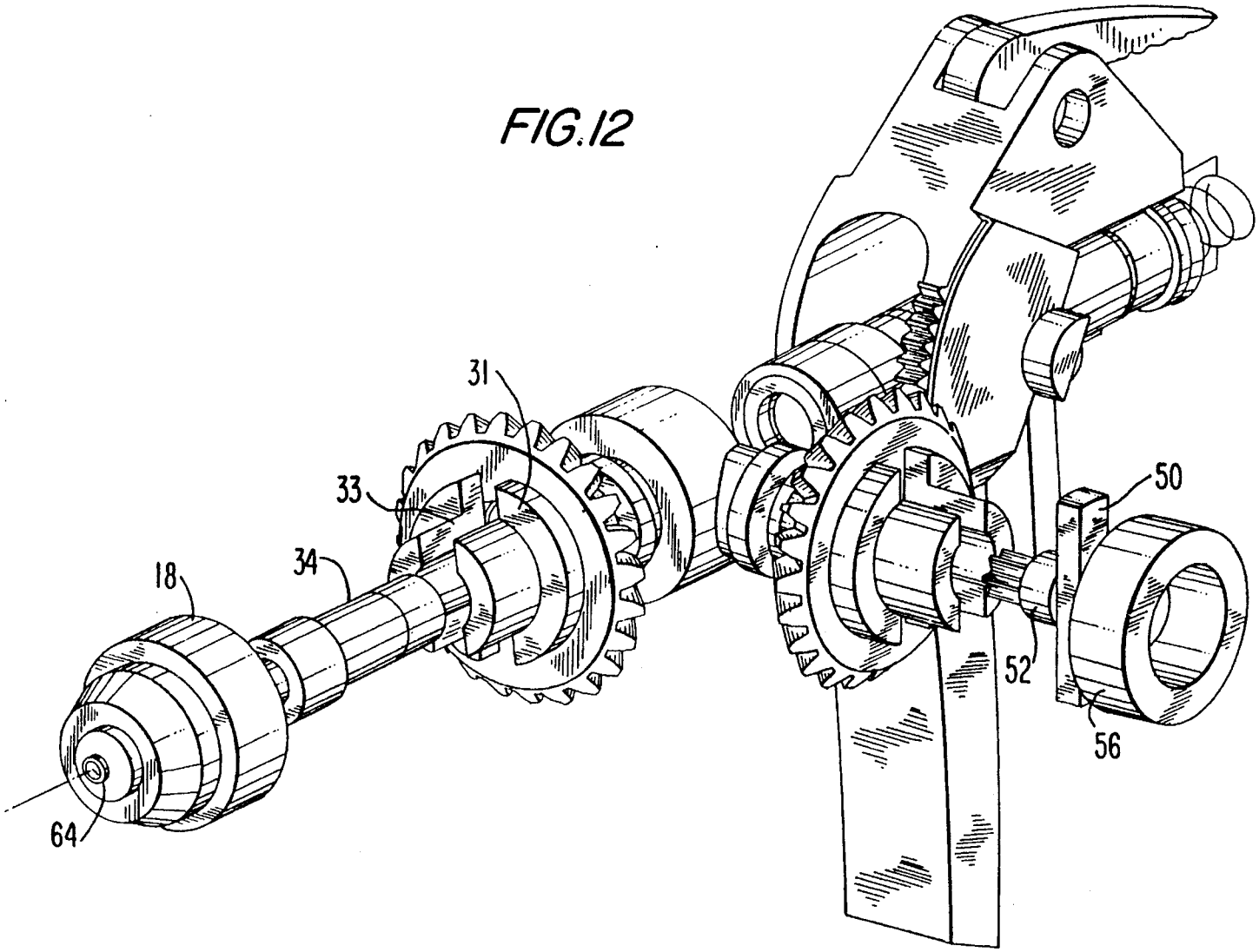
FIG. 12 is an exploded perspective view of the hand pump sprayer of FIG. 11 looking from the front right side.
Figure 13:
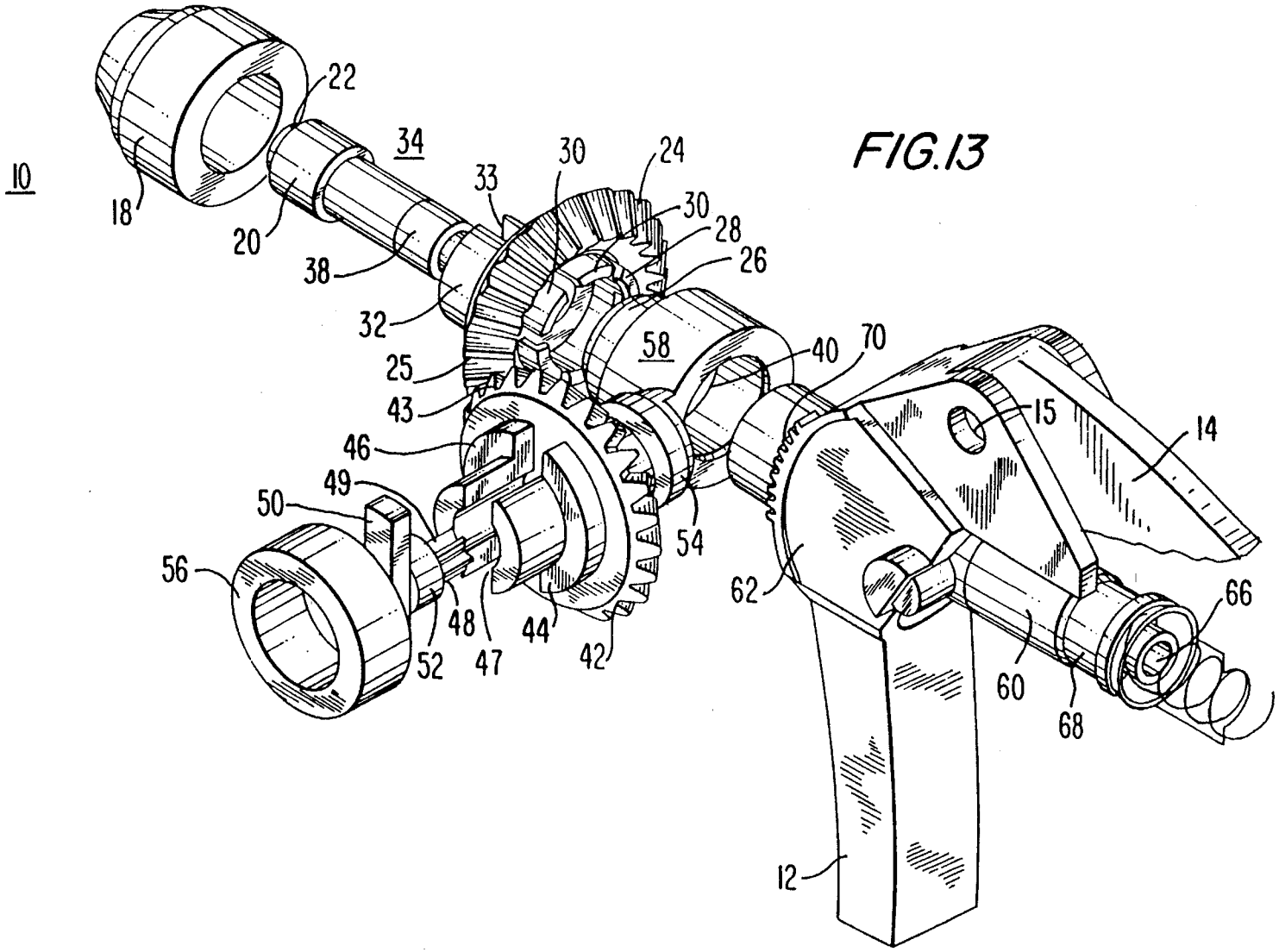
FIG. 13 is an exploded perspective view of the hand pump sprayer of FIG. 1 looking from the back left side.
Figure 14:
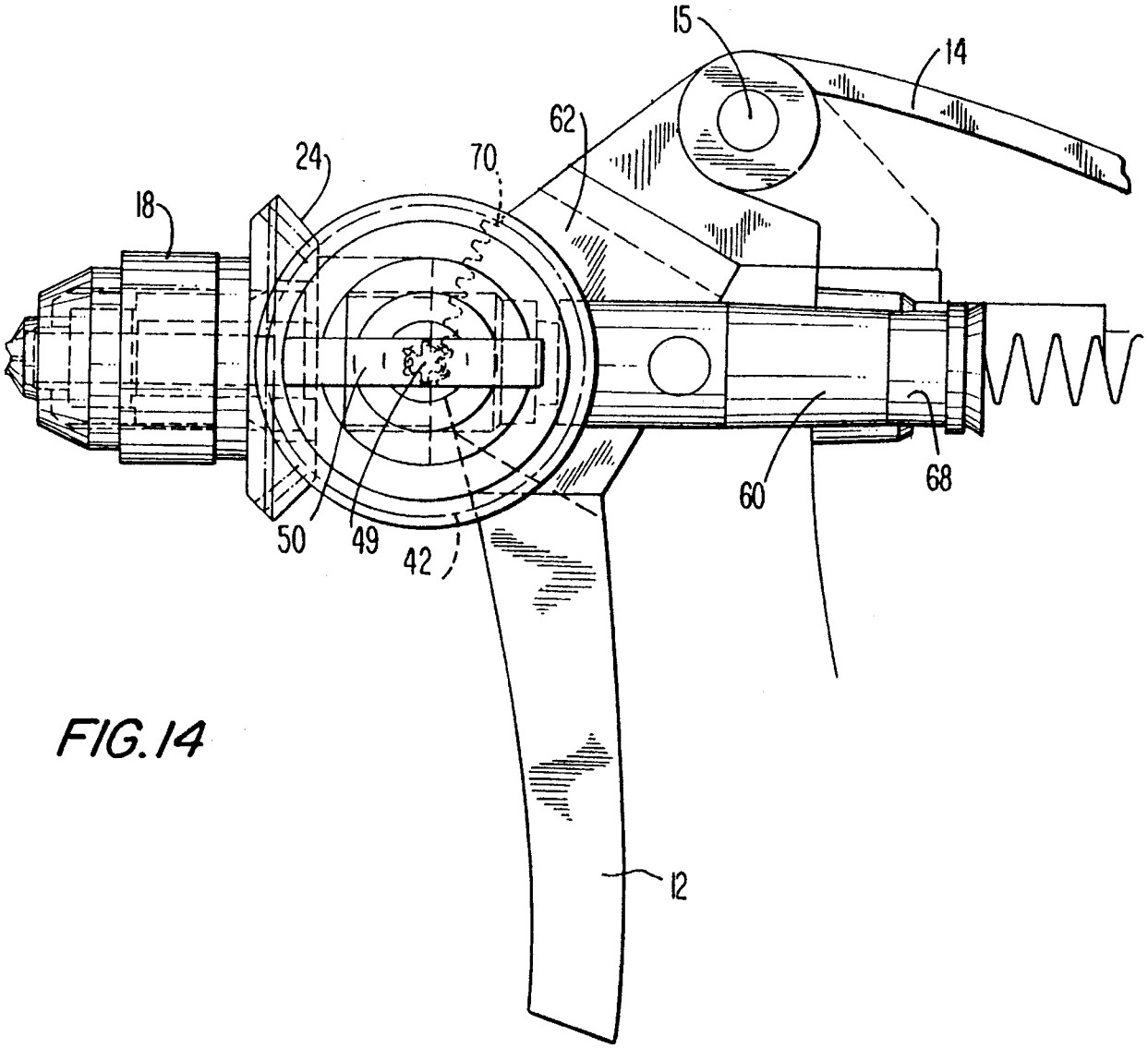
FIG. 14 is a right side sectional view of FIG. 11.

Referring to FIGS. 1 to 10, a hand pump sprayer 100 is provided with trigger 112 which is pivotly connected to pump housing 150 through pin 140. A nozzle 102 having angular outlets 103 for discharging fluid from the hand pump sprayer in colliding streams is provided, preferably as described in U.S. Pat. No. 5,088,649 (Hanson). A rack 104 having rack teeth 105 is held in place by rack positioner 108. The rack 104 can be disengaged by rotating rack positioner 108 about boss 136 in rack retainer 110 until rack positioner slot 111 is aligned with rack 104. Rack 104 then slides into slot 111. In such position, the nozzle 102 will not rotate. Rack retainer 110 is mounted to trigger 112 and holds the rack positioner 108 and the rack 104 in place. It should be understood that alternatively the rack 104 could be integral with the trigger 112 e.g., molded or the like. Nozzle drive gear, preferably pinion assembly 106 having pinion teeth 107, is provided for engagement with rack 104. Pinion assembly 106 is axially aligned with nozzle 102. As best seen in FIG. 4 and FIG. 5A, nozzle 102 is snap mounted into nozzle housing 116 in pinion assembly 106. Pinion assembly fluid passageway 114 is provided through the middle of the generally cylindrically pinion assembly 106 and brings fluid to the nozzle 102. As best seen in FIG. 4 and FIG. 6, pinion seal 120 is provided for mounting in the inlet end of pinion assembly 106 in bore 119. As shown in FIG. 4 and FIG. 8A pinion assembly 106 slides into generally cylindrical plunger 122 through plunger hollow 123. Pinion assembly 106 is held in place by U-shaped pinion retainer 130 which slides through holes 131 in plunger 122 and bares against circular groove 118 in the outside wall of pinion assembly 106 to thereby securely interconnect the pinion assembly 106 to the plunger 122. Adjacent the pinion assembly 106 within the plunger hollow 123 is pinion assembly seal 120. The seal 120 prevents fluid leakage around the pinion assembly 106. Adjacent the pinion assembly seal 120 is check valve spring retainer 124 for receipt and retention of spring 126. A conventional check valve 128 is located within plunger hollow 123 adjacent to spring 126. Adjacent to plunger 122 is plunger seal 125 to priest leakage from the plunger 122. The fluid passageway 132 extends through the entire assembly and brings fluid to pinion fluid passageway 114 from the reservoir. Fluid passageway 132 is then interconnected in a conventional manner to the reservoir through a dipstick or the like not shown.

In operation the liquid is pumped by the action of the trigger and the plunger liquid is brought from the reservoir to the delivery passageway in a conventional manner, see for example, U.S. Pat. Nos. 4,646,969 or 3,927,834. As the trigger is pulled the rack 104 moves back and forth simultaneously with the pulling of the trigger 112 and rotates the pinion assembly 106 which in turn simultaneously rotates the nozzle located in the nozzle housing 116 in the pinion assembly 106. As a result, liquid is drawn from the reservoir through the delivery passageway which is composed of pinion assembly fluid passageway 114 and fluid passageway 132 and expelled under pressure to the atmosphere through the nozzle outlets 103 in colliding streams. Simultaneously with the discharge of the fluid from the nozzle, the nozzle rotates through an angle of 90° to 360°, preferably from 180° to 360° and most preferably 270° or more. The resulting fluid preferably a viscous liquid having a viscosity of 60 to 100 cps, most preferably from 60 to 85 cps is discharged in a fine mist in a circular pattern. When the rack is moved back and forth the pinion assembly 106 is rotated by the rack and rotates the nozzle 102 which is snap fitted into the nozzle housing 116. The rack rotates the pinion assembly 106 and the nozzle 102 about an axis X of rotation through the center of the discharge end of the nozzle through an angle of rotation of from 90° to 360° preferably from 180° to 360° and most preferably 270° or more.

It should be understood that alternative methods of rotating the nozzle are contemplated by the invention. As shown in the alternative embodiment shown in FIGS. 11 to 14, the nozzle drive gear is driven indirectly by the trigger through several interconnected gears.

Referring to the FIGS. 11 to 14, hand pump sprayer 10 is provided with a trigger 12 which is pivotly connected to pump housing 14 through preferably a pivot pin 15. A nozzle 18 is rotatably mounted to the hand pump sprayer for rotation about an axis of rotation X through the center of the nozzle. Nozzle 18 preferably has two nozzle outlets 64. Optionally a single nozzle outlet which is offset from the axis of rotation can be used. Desirably the nozzle outlets 64 provide colliding streams of fluid intersecting at a point outside the nozzle such as described more fully in U.S. Pat. No. 5,088,649 which is herein incorporated by reference. A hollow rod 34 interconnects nozzle 18 with fluid passageway 66 through fluid passageway housing 68. The hollow rod 34 has a cylindrical nozzle seal 20 having a blunt nose 22 at the nozzle end of a hollow rod 34. The blunt nose 22 forms a seal with nozzle 18 to prevent fluid from leaking from the hollow rod 34 during dispensing. Hollow rod 34 is interconnected with the fluid passageway of the pump sprayer to complete the delivery passageway of the pump sprayer and to deliver fluid to the nozzle 18 from the reservoir. Integral with hollow rod 34 is seal ring 38. The nozzle 18 is rotated about the axis of rotation X preferably by a convenient gearing arrangement interconnected to the trigger 12 so that the back and forth trigger movement is translated to rotational movement of the nozzle 18. Simultaneously with the delivery of pressurized fluid to the atmosphere, the nozzle 18 is rotated about the axis X through the middle of the nozzle 18.

A nozzle drive gear such as bevel gear 24 is interconnected with nozzle 18. Integral with the nozzle drive gear 24 is segmented snap ring 28 having segments 30 and threaded concentric hub 32 and slotted collar 31. Nozzle 18 contains internal threads and is screwed onto threaded concentric hub 32 for rotatable movement as nozzle drive gear 24 rotates. The threads are not shown in the Figures. A gear platform 58 having a passageway 40 is provided. Fluid from the pressurized reservoir flows through passageway 40 which is interconnected with fluid passageway 66. Plunger 60 seals passageway 40 from liquid leaks. Mounting ring 26 is mounted to gear platform 58 concentrically to the outlet of passageway 40. Mounting ring 54 is mounted to the side of gear platform 58 substantially perpendicularly to mounting ring 26. The mounting rings 26 and 54 preferably are integral with gear platform 58. Nozzle drive gear 24 is mounted to mounting ring 26 through a snap connection through segmented snap ring 28. Hollow rod 34 fits through the slot 33 in hub 32 and slotted collar 31 and then through passageway 40 to interconnect with fluid passageway 66.

A second bevel gear 42 which is identical to nozzle drive gear 24 is provided and interconnected at a right angle to nozzle drive gear 24. Teeth 25 of gear 24 and teeth 43 of gear 42 are operatively intermeshed so that the movement of gear 42 is translated into rotational movement of gear 24. Gear 42 is mounted to the hand pump sprayer 10 through gear platform 58 and through mounting ring 54 in the same manner previously described for gear 24. Gear 42 includes a segmented snap ring (not shown) having segments identical to those shown in gear 24. In the same manner as gear 24 is mounted to mounting ring 26, gear 42 is mounted to mounting ring 54 for snap engagement therewith. Integral with gear 42, are slotted collar 44 and slotted threaded concentric hub 46. Slot 47 extends through concentric hub 46 and slotted collar 44. A pinion assembly 48 consisting of a pinion 49 mounted to a cylindrical collar 52 terminating in arms 50 is provided. The pinion 49 snugly fits into slot 47 in slotted collar 44 and threaded concentric hub 46. Arms 50 are received in flush relationship with slotted collar 44 so that the arms 50 slide through the slot 47 and snugly engage in slotted collar 44. Pinion retainer ring 56 is provided to hold pinion assembly in place. Gear 42 rotates in tandem with pinion 49 and is moved by the action of arms 50 against collar 44 to rotate gear 42.

A rack preferably an arcuate (curved) rack 70 is attached to trigger 12 for rotational engagement of pinion 49 upon the movement back and forth of the trigger 12 during spraying. In operation, the trigger 12 is pulled by the user. The liquid is traveling from the reservoir and pressurized as is conventional in hand pump sprayers. See, for example, U.S. Pat. No. 3,927,834. As the trigger 12 is pulled back and forth the rack 70 rotates pinion 49 which rotates arm 50 which in turn rotates gear 42 which rotates nozzle drive gear 24 which in turn rotates the nozzle simultaneously as the fluid is ejected to the atmosphere.

The fluid, preferably a viscous liquid, is then dispensed in fine droplets in a circular spray pattern.

The nozzle rotation mechanism can be easily disengaged by the user. To disengage the rotation of the nozzle 18, the retainer ring 56 is loosened or removed. Arms 50 of pinion assembly 48 are pulled to move the pinion 49 from engagement with gear rack 70. As a result, the nozzle 18 will no longer rotate.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

I claim:

1. A hand pump sprayer wherein fluid is brought from a reservoir, pressurized and brought to an outlet of a delivery passageway and dispensed to the atmosphere upon pulling a trigger comprising:

a nozzle having a nozzle inlet and a nozzle outlet means and a nozzle center;

said nozzle inlet in fluid communication with said outlet of said delivery passageway;

said nozzle rotatably mounted to said hand pump sprayer for rotation of said nozzle from 90° to 360° about an axis of rotation through the nozzle center;

a trigger interconnected to said nozzle to rotate said nozzle around said axis of rotation simultaneously with the dispensing of the fluid to the atmosphere, upon the pulling of said trigger.

2. A hand pump sprayer according to claim 1 wherein said rotation of said nozzle is from 180° to 360°.

3. A hand pump sprayer according to claim 1 wherein said rotation of said nozzle is 270° or greater.

4. A hand pump sprayer according to claim 3 wherein said reservoir includes a viscous liquid having a viscosity over 60 cps.

5. A hand pump sprayer according to claim 3 wherein said nozzle outlet means includes a first and a second outlet to discharge liquid to the atmosphere along a first and second discharge axis; said axes intersecting at a collision point exterior to said nozzle.

6. A hand pump sprayer according to claim 5 wherein first and second outlets are located on opposite sides of the axis X of rotation.

7. A hand pump sprayer according to claim 3 wherein said nozzle outlet means has a single nozzle outlet located eccentrically to the axis X of rotation.

8. A hand pump sprayer wherein fluid is brought from a reservoir, pressurized and brought to an outlet of a delivery passageway and dispensed to the atmosphere upon pulling a trigger comprising:

a. a trigger interconnected to a piston for pressurizing said fluid;

b. a nozzle having nozzle inlet and nozzle outlet means and a nozzle center;

c. a delivery passageway in fluid communication with said reservoir and said nozzle;

d. means for delivering said fluid to said delivery passageway when said trigger is pulled;

e. said nozzle rotatably mounted to said hand pump sprayer for rotation of from 180° to 360° about an axis X through said nozzle center;

f. a drive gear interconnected to and operatively driven by said trigger;

g. a nozzle gear operatively connected to said drive gear for rotational movement;

h. said nozzle interconnected to said nozzle gear so that said nozzle is rotated by said nozzle gear from 180° to 360° about the axis X through the nozzle center simultaneously with the dispensing of said pressurized fluid through said nozzle to the atmosphere through said nozzle outlet means when said trigger is pulled.

9. A hand pump sprayer according to claim 8 wherein said nozzle rotates about the axis X through 270° or greater.

10. A hand pump sprayer according to claim 8 wherein the nozzle outlet means includes a first and a second outlet to discharge liquid to the atmosphere along a first and second discharge axis; said axes intersecting at a collision point exterior to said nozzle.

11. A hand pump sprayer according to claim 10 wherein first and second outlets are located on opposite sides of the axis X of rotation.

12. A hand pump sprayer according to claim 8 wherein said nozzle has a single nozzle outlet located eccentrically to the axis X of rotation.

13. A hand pump sprayer according to claim 10 wherein said drive gear is a gear rack attached to said trigger;

said nozzle gear is a pinion directly interconnected with gear rack.

14. A hand pump sprayer according to claim 13 further comprising means to selectively disengage said nozzle gear from said drive gear so that said hand pump sprayer can be operated without the rotation of said nozzle.

15. A hand pump sprayer according to claim 13 further comprising said pinion axially aligned with said nozzle to rotate said nozzle simultaneously with the rotational movement of said pinion.

16. A hand pump sprayer according to claim 15 wherein said pinion includes a nozzle housing for receipt and axial alignment of said nozzle with said pinion.

17. A hand pump sprayer according to claim 16 wherein said pinion includes a fluid passageway therein interconnecting said delivery passageway to said nozzle.

18. A dispensing system for spraying liquids comprising:

a liquid to be sprayed;

a reservoir for holding said liquid;

a hand pump sprayer wherein the liquid is brought from a reservoir, pressurized and brought to an outlet of a delivery passageway and dispensed to the atmosphere;

said hand pump sprayer comprising:

a. a trigger interconnected to a piston for pressurizing said liquid;

b. a nozzle having a nozzle inlet and a nozzle outlet means and a nozzle center;

c. a delivery passageway in fluid communication with said reservoir and said nozzle;

d. means for delivering said liquid to said delivery passageway when said trigger is pulled;

e. said nozzle rotatably mounted to said hand pump sprayer for rotation from 180° to 360° about an axis X through said nozzle center;

f. a drive gear interconnected to and operatively driven by said trigger;

g. a nozzle gear operatively interconnected to said drive gear for rotational movement;

h. said nozzle interconnected to to said nozzle gear so that said nozzle is rotated by said nozzle gear from 180° to 360° about the axis X through said nozzle center simultaneously with the dispensing of said pressurized liquid through said nozzle to the atmosphere through said nozzle outlet means when said trigger is pulled.

19. A dispensing system according to claim 18 wherein said liquid is a viscous liquid having a viscosity of 60 cps or greater.

20. A dispensing system according to claim 19 wherein said liquid has a viscosity from 60 cps to 100 cps.

21. A dispensing system according to claim 20 wherein said liquid has a viscosity from 60 cps to 85 cps.

22. A dispensing system according to claim 20 wherein said viscous liquid is selected from the group consisting of vegetable oil, vegetable oil lecithin mixtures, paint pigments in linseed oil, petroleum products, lubricants, adhesives and resins.

23. A dispensing system according to claim 22 wherein said liquid includes vegetable oil.

24. A dispensing system according to claim 22 wherein said liquid is hair spray resin.

25. A dispensing system according to claim 22 wherein said liquid is a lubricant.

26. A dispensing system according to claim 22 wherein said liquid is an adhesive.

27. A dispensing system according to claim 20 wherein said drive gear is a gear rack attached to said trigger;

said nozzle gear is a pinion directly interconnected with said gear rack.

28. A dispensing system according to claim 20 further comprising means to selectively disengage said nozzle gear from said drive gear so that said hand pump sprayer can be operated without rotation of said nozzle.

29. A dispensing system according to claim 28 wherein said liquid is a viscous vegetable oil containing composition having a viscosity of 60 cps or greater.

30. A dispensing system according to claim 29 wherein said nozzle outlet means has a first and a second discharge outlet to discharge fluids flowing from said nozzle along a first and second discharge axis;

said first and second discharge axes intersecting at a collision point exterior to said nozzle discharge outlets.

31. A dispensing system according to claim 29 wherein said nozzle outlet means has a single discharge outlet located eccentrically to said axis X of rotation.

* * * * *